United States Patent [19]

Stone et al.

[11] Patent Number: 4,582,202

[45] Date of Patent: Apr. 15, 1986

[54] CENTRIFUGAL SORTING METHOD

[75] Inventors: Lawrence H. Stone, River Vale, N.J.; C. G. M. Dickson, Willowdale, Canada

[73] Assignee: Kason Corporation, Linden, N.J.

[21] Appl. No.: 698,255

[22] Filed: Feb. 4, 1985

Related U.S. Application Data

[63] Continuation of Ser. No. 430,206, Sep. 30, 1982, abandoned.

[51] Int. Cl.[4] ..... B07B 1/22

[52] U.S. Cl. ..... 209/683; 209/284; 209/291

[58] Field of Search ..... 209/683, 44.3, 660, 209/687, 690, 284, 288, 289, 290, 291, 369

[56] References Cited

U.S. PATENT DOCUMENTS

| | | | |
|---|---|---|---|
| 284,405 | 9/1983 | Forder et al. | 209/298 |
| 415,709 | 11/1889 | Etzold | 209/291 |
| 608,230 | 8/1898 | Scott et al. | 209/290 |
| 772,331 | 10/1904 | Baxter | 209/289 |
| 912,098 | 2/1909 | Feickert | 209/683 |
| 1,141,169 | 6/1915 | Biesanz | 209/291 |
| 1,223,607 | 4/1917 | Pantaze | 209/291 |
| 1,359,685 | 11/1920 | Frederick | 209/236 |
| 1,430,664 | 10/1922 | Madson | 209/291 |
| 1,581,686 | 4/1926 | O'Toole | 209/291 |
| 1,668,629 | 5/1928 | Church | 209/291 |
| 2,516,953 | 8/1950 | Derbenwick et al. | 209/284 |
| 2,601,924 | 7/1952 | Gonder | 209/291 |
| 3,394,808 | 7/1968 | Thompson | 209/291 |
| 3,756,406 | 9/1973 | Kahn | 209/291 |
| 3,779,253 | 12/1973 | Labbe | 131/110 |
| 4,115,257 | 9/1978 | Mugler | 209/291 |
| 4,202,759 | 5/1980 | Krolopp et al. | 209/234 |
| 4,312,750 | 1/1982 | Braun et al. | 209/291 |

FOREIGN PATENT DOCUMENTS

| | | | |
|---|---|---|---|
| 13023 | of 1895 | United Kingdom | 209/687 |
| 219625 | 7/1924 | United Kingdom | 209/687 |
| 0563195 | 6/1977 | U.S.S.R. | 209/291 |

OTHER PUBLICATIONS

Kason Corp. "The Kason Centri-Sifter" Bulletin CS-77, May, 1979.

Prater Industries, Inc., "Rota Sieve", Bulletin RS75, 1974.

*Primary Examiner*—David A. Scherbel
*Assistant Examiner*—Donald T. Hajec
*Attorney, Agent, or Firm*—Wolder, Gross & Yavner

[57] ABSTRACT

A method for the sorting of bulk material comprises the feeding of the bulk material into a frusto-conical sorting means. The rotational speed of the sorting means is varied to permit the passage of the bulk material therethrough at the higher speed and the migration of tramp material along the sorting means at the lower speed. Continuously alternating the speeds allows sorting to be done on a continuous basis.

4 Claims, 3 Drawing Figures

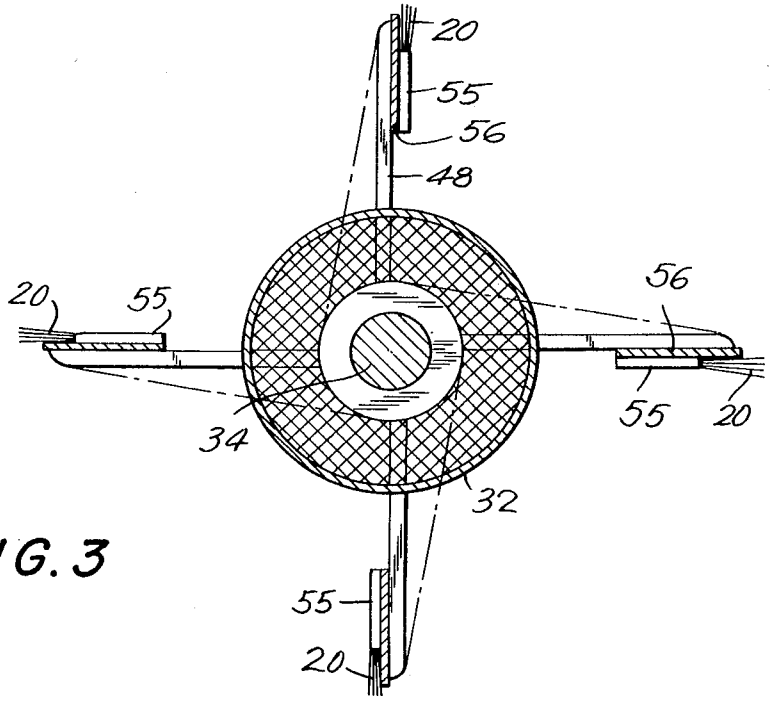
FIG. 3
FIG. 2
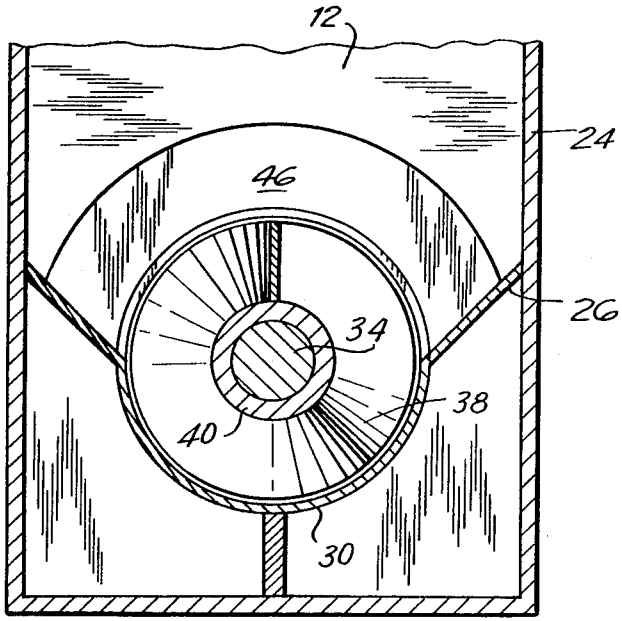

CENTRIFUGAL SORTING METHOD

This application is a continuation, of application 430,206, filed Sept. 30, 1982, now abandoned.

The present invention relates generally to centrifugal sorting apparatus, and in particular to a centrifugal sorting apparatus for sorting bulk materials in which undesirable large sized objects, commonly known as "tramp" material may be found.

Centrifugal type sorting apparatus finds great utility in numerous industries, including the chemical, foods, dairy product, pharmaceutical and plastic industries. Such devices are used to sort or sift both dry powder or granular material. Often the bulk material sought to be sorted or sifted includes a variety of undesirable materials of a larger size. These materials can include unprocessed or partially processed raw material, metallic items, or even tools and parts of equipment utilized upstream in the refining process. As the materials sought to be sifted are normally of a relatively small diameter or high mesh, the screening material used to separate such material from the undesirable elements is relatively fragile and thus subject to ripping or other damage when contacted by the undesirable materials, especially when such materials are accelerated to a relatively high velocity by the action of the sifter apparatus. The bulk material is sorted by the screen which permits the small diameter bulk material particles, or "fines" to pass through the mesh, while retaining the larger particles, or "overs", as well as the tramp material or tailings in the chamber.

The prior art has attempted to overcome the damage problem by providing an intermediate screen or sorting element which is of a construction that renders it relatively immune to damage from tramp material. Such devices, however, may be subject to clogging if the tramp material is not removed on a periodic basis. It is therefore a purpose of the present invention to provide an improved centrifugal sorter or sifter which allows for continuous operation over an extended period of time.

A further object of the present invention is to provide a sifter apparatus in which the tramp material may be removed on a continuous basis.

Yet a further object of the present invention is to provide a centrifugal sifter in which a constant flow of sifted material through the apparatus is provided for.

These and other objects are provided for in the present invention by way of a centrifugal sifting apparatus comprising both an input hopper and a sorting chamber. An auger moves bulk material sought to be sifted from the input hopper into the sorting chamber, which includes an inner initial sorting means in the form of a frusto-conical assembly, rotatable along its major axis. Centrifugal force directs the bulk material and tramp material against the first sorting means with the wanted bulk material passing through. Some tramp material may migrate along the wall of the sorting means, while the remainder will remain stationary. When the apparatus is shut down, the remaining tramp material moves down the incline. The repeated starting and stopping of the apparatus during normal operation helps insure that the tramp material moves along the cone to be collected. A second cylindrical sorting means is mounted within the sorting chamber concentric with and exterior to the first sorting means. The second sorting means is of a fineness sufficient for the desired operation. A series of brush means can be mounted to the initial sorting means and project outwardly against the second sorting means, thus providing a sweeping action which can help drive near size bulk material through the second sorting means. This insures that the initially sifted material continuously passes through the apparatus and does not collect between the sorting means to clog the apparatus. Means may be provided for the selective collection of the tramp material as well as the siftings.

The above brief description as well as further objects and advantages of the invention will be more fully appreciated with reference to the following detailed description of a preferred, but nonetheless illustrative embodiment, when taken in conjunction with the following drawings, wherein:

FIG. 2 is an end elevation view of the invention taken along line 2—2 of FIG. 1; and FIG. 3 is an end elevation view taken along line 3—3 of FIG. 1.

Figure 1:
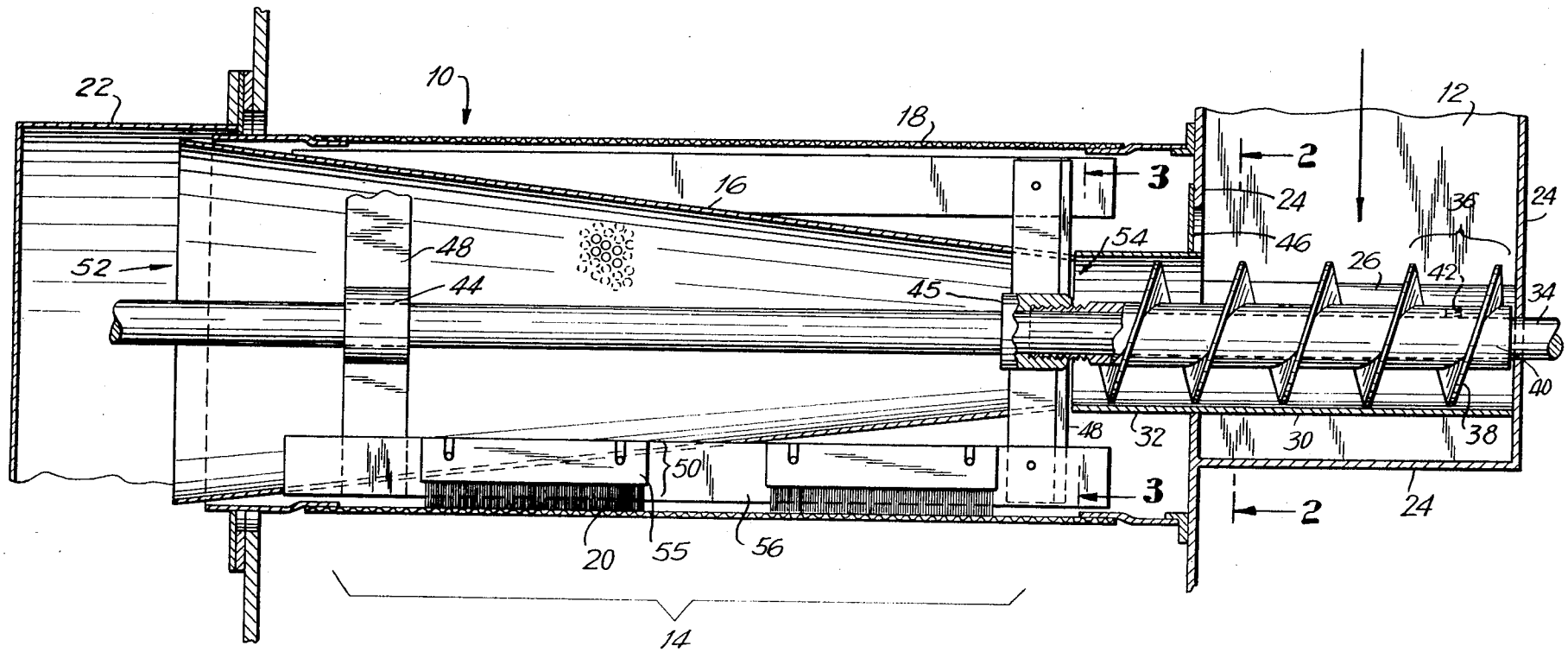
FIG. 1 is a cross-sectional elevation view of the present invention.

Referring to the figures, apparatus 10 includes input hopper 12 mounted for communication with sorting chamber 14. Sorting chamber 14 includes inner frusto-conical first sorting means 16 and cylindrical, concentric outer second sorting means 18. Brushes 20 may be used to sweep along the inner surface of outer sorting means 18 to assist in dislodging near size material from the outer sorting means. Located at the second end of sorting chamber 14 is tailings cover and guide means 22.

As may be seen with reference to FIGS. 1 and 2, input hopper 12 includes body walls 24 which form a rectangular container with an open top. Supported within input hopper 12 by side plates 26 and bottom plate 28 is false bottom 30. False bottom 30 extends beyond the left end of input hopper 12 as shown in FIG. 1, and is semi-cylindrical within input hopper 12 and fully cylindrical beyond the left end of input hopper 12 in area 32. Shaft 34 extends through input hopper 12 and sorting chamber 14 and is mounted for rotation therein by appropriate means (not shown). Mounted on shaft 34 for rotation within input hopper 12 is auger 36, comprising heical feed screw 38 mounted on sleeve 40 The outer diameter of auger 36 is such that it coacts with the false bottom plate to provide an effective means for driving inputted bulk material along the length of the feed screw. Feed screw 36 is mounted to shaft 34 by set screw 42. Retaining plate 46 helps support the extension portion 32 of false bottom plate 30 beyond input hopper 12. In a typical application feed screw 36 may have a pitch of 2-$\frac{1}{2}$ inches and have a crest-to-crest diameter of 3-$\frac{3}{4}$ inches. A two-inch inner radius for false bottom 30 provides the necessary tolerance for successful transport of the bulk material.

Within sorting chamber 14, first sorting means 16 is mounted for rotation with shaft 34 by means of cylindrical bosses 44 and 45, each of which is secured to the shaft by set screws (not shown) sleeve 40 may be threaded, along with boss 45, to mate the auger to sorting means 16. Extending radially outward from the bosses are paddle arms 48, which pass through the wall of first sorting means 16 for support of brush assemblies 50. First sorter means 16 is frusto-conical in shape, with open ends 52 and 54. Sorter 16 is mounted on shaft 34 such that smaller diameter rightmost end 54 is adjacent the leftmost end of cylindrical extension 32 of false bottom plate 30. In the embodiment described herein, first sorting means 16 may be approximately 24 inches in length with a maximum diameter of approximately 10 inches. A preferred material may be 16 gauge metallic plate material having 3/16 inch diameter holes staggered across its surface on 5/16 centers. The structure may be developed from four identical gores welded along their length to provide the desired construction. Paddle arms 48, which may be of angle stock, may be welded or otherwise mounted to first sorting means 16 at the locations at which they pass through its walls. The angle which the wall of first sorting means 16 subtends with respect to its axis of rotation about shaft 34 must be sufficient to permit the the tramp material to move along the inner surface of the sorter during start/-stop operation and is preferably a minimum of 7°.

Second, outer sorting means 18 is mounted concentrically with first sorting means 16 and is supported by support members 48 and angle brackets 50 mounted to portions of hopper body walls 24. It may be comprised of a suitable mesh material, either of metal or other appropriate material, having a pore or aperture size consistent with product screening requirements.

Individual brush units 50 are mounted for rotation with first sorter means 16 and are comprised of brushes 20 projecting outwardly from bristle mounts 55. Bristle mounts 55 are themselves mounted on horizontal paddles 56 which are affixed to paddle arms 48. The paddles have a slight helical twist to them which allows them to propel oversize material along the length of the outer sorting means.

In operation shaft 34 is energized to rotate such that auger 38 draws bulk material fed into input hopper 12 into the right, narrow diameter end of first inner sorter means 16. The centrifugal action of that sorter means directs the smaller diameter material out through the perforations thereon and into the annular space between the first inner sorter means 16 and the second outer sorter means 18. The action of paddles 56 and brush units 50 assist in moving the bulk material through second sorting means 18, where it is collected by an appropriate receptacle (not shown). Larger diameter material, such as tramp metal, remains within frusto-conical first sorting means 18 and migrates during each stop period under the influence of gravity to left open end 52. They then exit the sorting chamber and are collected by end cover 22 for disposal or processing as required. A further collection means may be provided for removal and collection of bulk material which passes through first sorting means 16 but is unable to pass through second sorting means 18.

Although the invention has been described as applied to a specific embodiment, it will be clear that many modifications and adaptations can be easily accomplished within the scope of the invention claimed.

What is claimed is:

1. A method for the sorting of bulk material having unwanted tramp material therein in a centrifugal sorting apparatus comprising the steps of:

(a) loading the bulk material into a first end of a rotatable sorting means of frusto-conical shape;

(b) rotating said sorting means at a first speed sufficient to cause passage of a portion of the bulk material therethrough while substantially retaining the tramp material in a place therein;

(c) reducing said rotational speed to a second speed such that said tramp material can migrate along the sorting means to a second end exit for collection; and (d) alternating the said rotational speed between said first and second speeds to effect an essentially continuous migration of said tramp material along, and passage of said bulk material through, said sorting means.

2. The method of claim 1 wherein said second rotational speed is essentially zero.

3. The method of claim 1 wherein said loading of bulk material is on a continuous basis concurrent with said rotation of said sorting means.

4. The method of claim 1 further comprising the step of passing said bulk material through a second, coaxial sorting means.

* * * * *